United States Patent [19]

Hurst

[11] Patent Number: 4,869,394

[45] Date of Patent: Sep. 26, 1989

[54] ARTICLE COUNTING DEVICE

[76] Inventor: Kerney J. Hurst, 507 Eagle Dr., Pineville, La. 71360

[21] Appl. No.: 146,172

[22] Filed: Jan. 20, 1988

Related U.S. Application Data

[63] Continuation-in-part of Ser. No. 856,475, Apr. 28, 1986, abandoned.

[51] Int. Cl.[4] ..... B65B 57/20

[52] U.S. Cl. ..... 221/7; 221/186; 221/197

[58] Field of Search ..... 221/7, 197, 186, 263, 221/265, 277, 281, 267; 453/32, 34; 377/6

[56] References Cited

U.S. PATENT DOCUMENTS

| | | | |
|---|---|---|---|
| 3,170,627 | 2/1965 | Pearson et al. . | |
| 3,215,310 | 11/1965 | Hurst et al. . | |
| 3,368,713 | 2/1968 | Hurst et al. | 221/7 |
| 3,677,437 | 7/1972 | Haigler . | |
| 3,722,740 | 3/1973 | List . | |
| 3,823,844 | 7/1974 | Linkemer et al. . | |
| 3,837,139 | 9/1974 | Roseberg . | |
| 3,928,753 | 12/1975 | Kivett et al. | 221/211 X |
| 3,985,264 | 10/1975 | Shaw et al. . | |
| 4,013,192 | 3/1977 | Pillon . | |
| 4,018,358 | 4/1977 | Johnson et al. | 221/7 |
| 4,111,332 | 9/1978 | Hurst et al. | 221/7 |
| 4,396,828 | 8/1983 | Dino et al. . | |
| 4,483,431 | 11/1984 | Pratt . | |
| 4,664,290 | 5/1987 | Martin et al. | 221/211 |

*Primary Examiner*—F. J. Bartuska

*Attorney, Agent, or Firm*—Shlesinger & Myers

[57] ABSTRACT

Multiple small-article receiving cassettes are provided for removably mounting on the upper surface of an inclined support. A drum housed within each cassette is rotated by connection with the drive shaft of a motor projecting through the support. The disk-like bottom of the rotatable interior drum of the cassette is undercut to form a circumferential series of radial and angularly spaced article receiving slots with the innermost end of the slots in overlying relation with respect to an outlet opening formed in the bottom stationary plate of the cassette. A second outlet opening, located in the upper surface of the support, is aligned with the opening in the bottom of the cassette. Upon proper rotation of the drum, articles placed within the cassette will travel along the receiving slots to their innermost end and then drop through the two outlet openings and into a dispensing chute. A single electrical control and single motor is used with numerous different cassettes for dispensing different drugs. The motor is rotated until a desired number of pills is dispensed and is then stopped.

24 Claims, 7 Drawing Sheets

ARTICLE COUNTING DEVICE

RELATED APPLICATIONS

This is a continuation-in-part application of U.S. Ser. No. 06/856,475 filed Apr. 28, 1986 now abandoned from which priority is claimed under 35 U.S.C. 120.

BACKGROUND OF THE INVENTION

The present invention relates to machines for counting small articles and more particularly to a cassette and counter system for tablets and capsules, allowing convenient access to numerous different drugs.

Valuable time is used by pharmacists in the tedious operation of counting out the exact number of tablets or capsules required to fill individual prescriptions. This time could be well utilized by the pharmacist in filling out the label or instructions for the user, in receiving telephone prescriptions from a physician, or in performing many of the other activities that can only be done by a registered pharmacist. The high volume of prescriptions now being filled by pharmacists makes it desirable to provide a means for accurately counting out the required number of tablets or capsules for each particular prescription. Furthermore, some drug items may be purchased in bulk quantity which are then counted into groups and packaged in smaller containers for resale.

The prior art reveals a number of counting machines designed to count a predetermined number of pills or tablets, some of which deposit the respective pills or tablets in a separate container, which are also conveyed by the counting device. Some of the prior art machines are intended for the use of manufacturers where the articles are packaged in large quantity for bulk distribution rather than by the use of an individual pharmacist in filling a prescription for a relatively small number of pills or tablets.

The most pertinent of the prior art patents are U.S. Pat. No. 3,368,713, issued on Feb. 13, 1968, for Article Counting Device and U.S. Pat. No. 4,111,332, issued on Sep. 5, 1978, for Article Counting Device. The subject matter of Pat. No. 4,111,332 relating to the disks for segregating the pills for counting and the machine controls are incorporated herein by reference.

These patents employed a spring arm and a microswitch to detect the pills so as to overcome the problem with light sources and detectors. These problems stemmed from ambient light and dirt and dust on the windows. The use of spring arm and switch detectors however introduced several problems. First, and of considerable importance, are the space requirements of the system. Since the spring arm must be precisely located relative to the article to be dispersed, a separate detector had to be used for every tablet or capsule and thus a separate counting head was required for each different pill. In such systems as many as 6 to 200 different heads are employed. In these locations such as large hospitals, the need for quick delivery of large numbers of different pills renders the systems economical but smaller institutions and smaller drug stores cannot readily afford the cost and space of such systems.

The present invention is an improvement over the above-named patents and other prior article counting and delivery systems for use in smaller institutions and stores by significantly reducing the amount of space and equipment needed to dispense the same variety of drugs and the cost thereof also. Further the improved design prevents any tendency of a springy or spring loaded counter arm to ever bind or bend. Furthermore, if the counter arm is bent, it can scrape on the side of the slot in which it operates and fail to reset fast enough to count the next pill. If this happens an uncounted pill can pass through the exit opening thereby resulting in an inaccurate count. The unique count detector of the present invention eliminates inaccurate counts of this nature.

Further it has been found that microswitch sensors used as pill count detectors in prior devices are susceptible to erroneous readings if one attempts to detect different pills with one device. Mechanical detectors do not provide the necessary versatility to detect a wide variety of shapes or sizes of pills and thus a separate motor driven head with detector is used for each type of tablet or capsule. Further detection difficulties are created by irregular or non-standard shaped drugs. The detector of the present invention eliminates these problems and allows for articles of all shapes and sizes to be detected by a single detector.

Prior Pat. No. 4,111,332 has also suggested the use of other mechanical switches or photoelectric sensing devices. Photoelectric sensors, as indicated above, are sensitive to ambient light, dirt and dust, unlike the detector of the present invention.

Many of the prior art counting machines, but not those of the patents discussed above, provide a single hopper which must be emptied and refilled with the tablets or capsules to be counted and various controls must be set to accommodate the passage of various size capsules or tablets. Further as in the patents discussed above, the use of a separate hopper for each individual group of tablets or capsules along with drive means and counting circuitry for each hopper as presently practiced and is too expensive for all but the highest quantity users. The present invention eliminates the need for refilling and resizing along with eliminating the need for multiple drive means and counting circuitry.

SUMMARY OF THE INVENTION

The present invention allows access, counting and dispensing of any variety of drugs with only a single motor, platform and infrared count detector by utilizing a number of cassettes. In a first embodiment, each cassette is comprised of three major components, the cassette body having a top, side walls and a handle, the drum having a dome portion and a disk, and the cassette cover which provides an exit opening, a barrier and flipper springs. The user can assemble a cassette for dispensing of any desired drug through the combination of an appropriate drum having a disk sized and adjusted for a particular size and shape tablet or capsule with a cover having an appropriately sized exit. The drums and covers are configured to cooperate with any cassette body, the cassette bodies have no pill-specific features.

In a second embodiment, each cassette is comprised of an inner drum portion between a flat upper plate with a central drug receiving hole and a flat lower plate. In both embodiments, the lower plate of the cassette flatly contacts an inclined support. The cylindrical drum which contains the tablets or capsules is free to rotate within the cassette. The drum is rotated by a motor shaft projecting through the support and engaging the drum.

The disk-like bottom of the drum is undercut to form radial and angular outwardly open grooves or slots for receiving a tablet or capsule as disclosed in Pat. No. 4,111,332. By rotation of the drum, tablets or capsules received in the outermost portions of the slots travel along the slot to the innermost end portion, and the innermost end portion of the respective slots are successively passed over an opening formed in the cassette cover or the lower plate dependent upon the embodiment. This opening is of appropriate size for the drug to be dispensed as also disclosed in U.S. Pat. No. 4,111,332, and is aligned with an opening formed in the support. A detector, mounted below the support adjacent the opening, is tripped by the passage of a tablet or capsule, as it falls by gravity through the opening, for operating an electrical counting means.

Various different cassettes can be assembled (first embodiment) or are provided (second embodiment) to accommodate tablets or capsules of different sizes. The cassettes differ in the shape and configuration of the slots in the disk-like bottom of the drum, and in the size and shape of the opening in the cover of the bottom plate of the cassette. The various configurations of the slots are tailored to the geometry of the particular tablet or capsule to be dispensed thereby and are such as to prevent jamming of the slots, to assure rapid dispensing and to prevent more than one tablet or capsule from being dispensed at one time.

The support surface upon which the cassette rests while in operation, and through which the pills drop as they are counted on their way to the delivery chute, must be configured so as to provide an accurate count of whatever size or shape pill is being dispensed by the selected cassette. Provision is therefore made for the drop-out hole of the support surface to be sufficiently large to allow any available sized or shaped pill to easily pass through. The infrared detector is provided at a critical location with respect to this hole and at an appropriate angle to the platform to insure that any article passing through the hole will trip the detector.

The ability to utilize a single detector and counting means regardless of the size or shape of the pill or capsule is essential to the use of a single drive station.

The infrared detector is insensitive to light, dust, size, shape and virtually insensitive to dirt. Cleaning requires only a wipe of the windows over the source and detector. The cassettes of the first embodiment are easy to clean, the cover easily snaps off and the drum is completely removable making all components entirely accessible.

The system further comprises circuits for controlling the dispensing of capsules or tablets. The circuits which are disclosed in prior Pat. No. 3,368,713 and incorporated herein, provide a mechanism, for instance, push buttons, for inserting a desired count into a storage member. The desired cassette, preloaded with tablets or capsules, is placed in position on the inclined support surface. A start button may then be depressed to begin the counting and dispensing operation, or an automatic switch can be triggered by the placing of the cassette in operating position. Operation of the start button energizes the motor for rotating the drum of the selected cassette and also energizes several control elements to permit counting of the pills as dispensed. Upon operation of the start button, as indicated above, pills are dispensed from the selected cassette and detected until the desired count is attained. Totalizing of the count is accomplished by appropriate counters or other forms of totalizers located in the control unit. When the accumulated count of dispensed pills equals the preselected count, operation of the selected cassette is discontinued and the counter is automatically reset to a predetermined number. The cycle may then be repeated with the same or a different cassette using the same or a different count.

The system of the present invention utilizes one or more counting bases and numerous cassettes. The cassettes are filled with various drugs, a different cassette for each drug, and are stored on shelves, in slots or in any convenient manner near to the base. Any cassette will interact with any base. The operator of the dispensing system then has only to enter the desired number of pills to be counted into the counting control, select a cassette from the storage area and position it on the top surface of the base. The motor is activated and the desired pills are counted and dispensed.

The use of cassettes to store the drugs presents a substantial cost and space savings over equipping a pharmacy with numerous bases and hoppers, and is much more convenient than having a single base and hopper and having to empty the hopper after every count and to refill the hopper with the next drug desired to be counted and dispensed and then reset the controls for that specific hopper.

It is an object of the present invention to provide a single control and drug sensor and circuitry and drive means for a pill dispenser utilizing numerous cassettes, which sensor circuitry permits selection of the number of pills to be dispensed, accurate counting of the number of pills dispensed and stopping operation of the selected cassette when the selected number of pills has been dispensed.

It is an object of the present invention to provide a multitude of drums each having a distinctive disk, a number of covers each having a distinctive exit opening and a plurality of bases wherein a cassette for dispensing a desired drug can be readily constructed, without the aid of tools, from the combination of one base, one drum a one cover.

It is another object of the present invention to provide a platform for receiving a pill dispensing cassette wherein the platform is designed to readily receive various cassettes configured for dispensing a variety of tablets or capsules.

Still another object of the present invention is to provide a series of cassettes having differing slotted disks for dispensing tablets or capsules of progressive ranges of sizes of differing shapes.

Another object of the present invention is to provide infrared sensing of pills in an automatic dispensing apparatus whereby to materially reduce the effects of ambient or reflected light, dust, dirt and size and geometry on the sensing mechanism for the pills being dispensed.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DETAILED DESCRIPTION OF THE PREFERRED EMBODIMENTS

Figure 1:
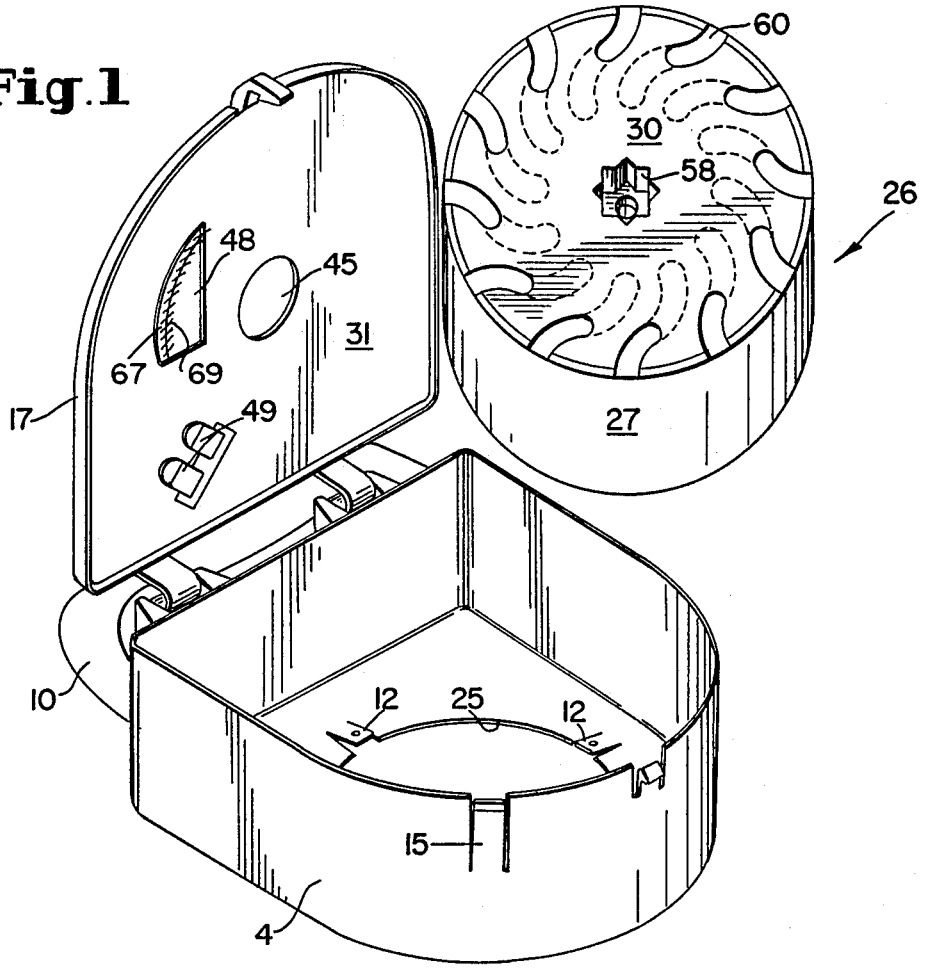
FIG. 1 is a perspective view of a partially assembled article holding cassette of the first embodiment.
Figure 4B:
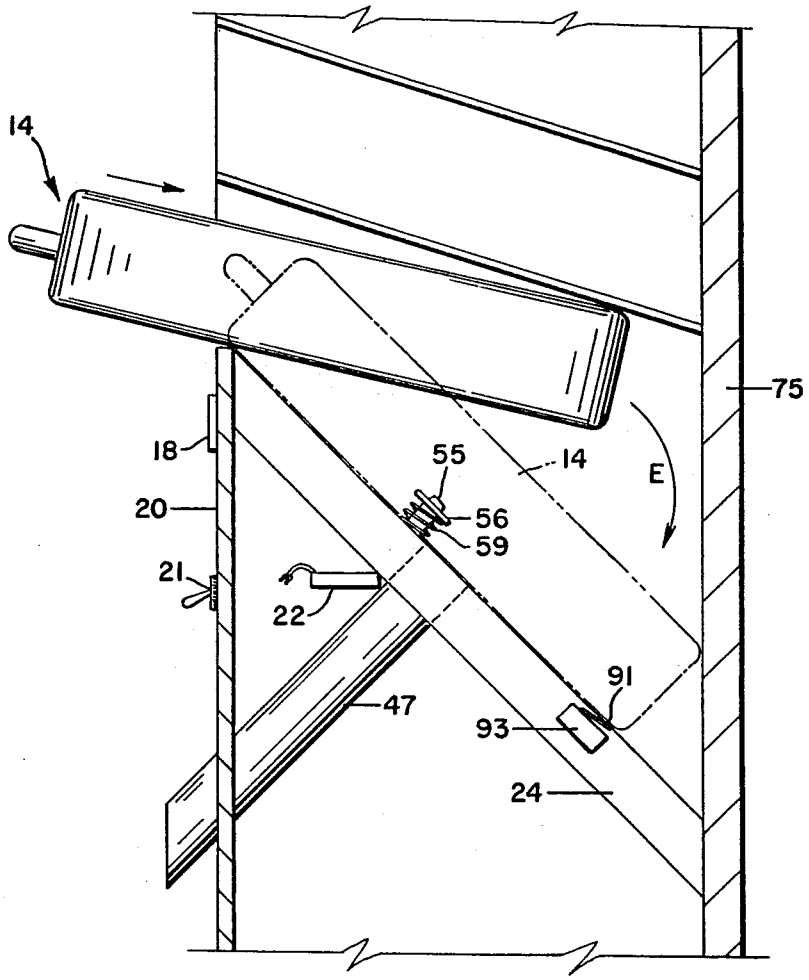
FIG. 4B is a side view in elevation of the first embodiment of the cassette supporting platform illustrating a cassette being operatively placed thereon.
Figure 4A:
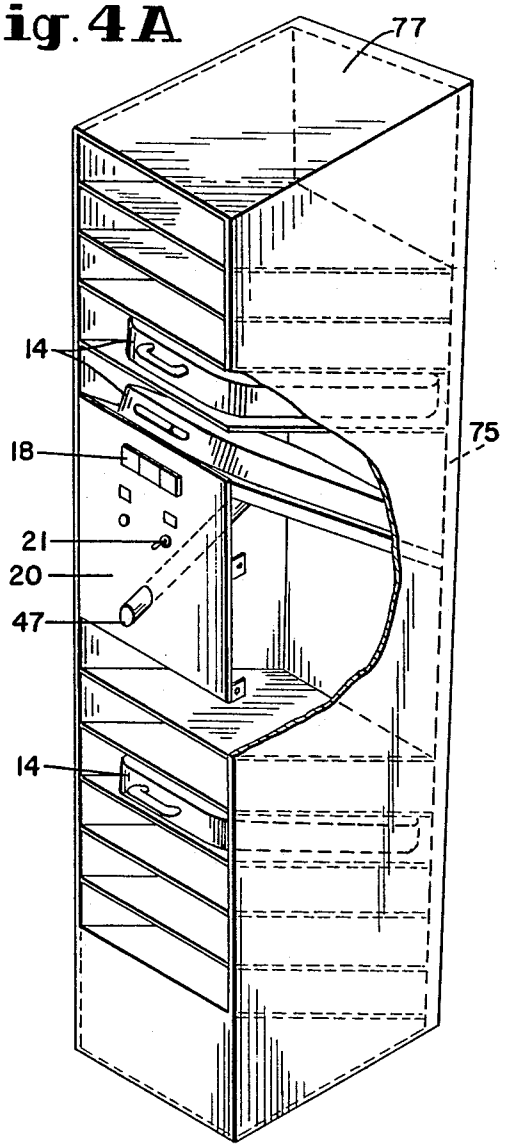
FIG. 4A is a perspective partial cutaway view of a cassette in position on a counting mechanism mounted in a cabinet.

Referring specifically to FIG. 4A of the accompanying drawings, the overall system of the present invention is comprised of two major elements; cassettes 14 and a counting unit 20. For a system in accordance with the present invention only a single counting unit 20 is necessary. However, numerous cassettes are desirable to accommodate a variety of pills, tablets or capsule sizes and shapes. Therefore, each system employs numerous cassettes each configured to accommodate a particular drug size and shape in conjunction with only a single counting unit. Each cassette is comprised of three major components (FIG. 1) a cassette body 4, a cassette cover 17 and a drum 26. The drum 26 containing the desired drug is housed within the body 4 and cover 17, and is therefore always ready to be positioned on the base for pill dispensing.

The drum 26 is comprised of a disk 30 and a dome portion 27. The disk 30 includes slots 60 better illustrated in FIGS. 9 and 16. The grooves are configured for dispensing a particular range of drug sizes and/or shapes. The cover 17 better illustrated in FIG. 10 includes an exit opening 48 which is also configured to accommodate a range of drug sizes and/or shapes. Both the disks and the exit opening can be selected from a variety of configurations. The matching of an appropriate disk and exit opening allows for proper accommodation of a desired drug.

Figure 8A:
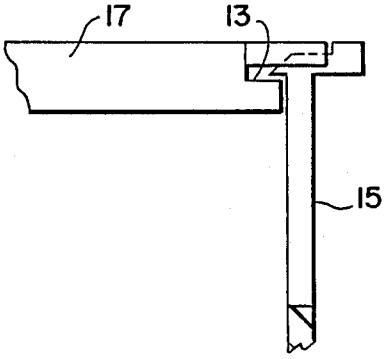
FIG. 8A is a side view of a cassette cover latch.
Figure 8B:
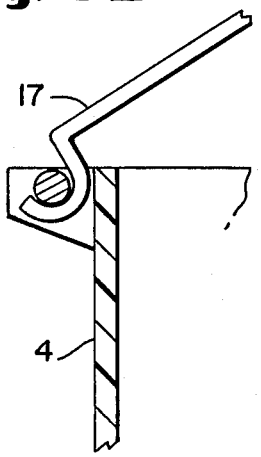
FIG. 8B is a side detail view of a cassette hinge.

The body 4 is of a single configuration which accommodates any drum 26 and any cover 17. The cover 17 is hingedly attached to the body 4 as better illustrated in FIG. 8B. By rotation of the hinge mechanism the cover 17 can be easily removed and replaced with another cover. The cover 17 and body 4 are held together by the interaction of clips 15 positioned on the body 4 and receptacles 13 in cover 17, as better illustrated in FIG. 8A.

Figure 2:
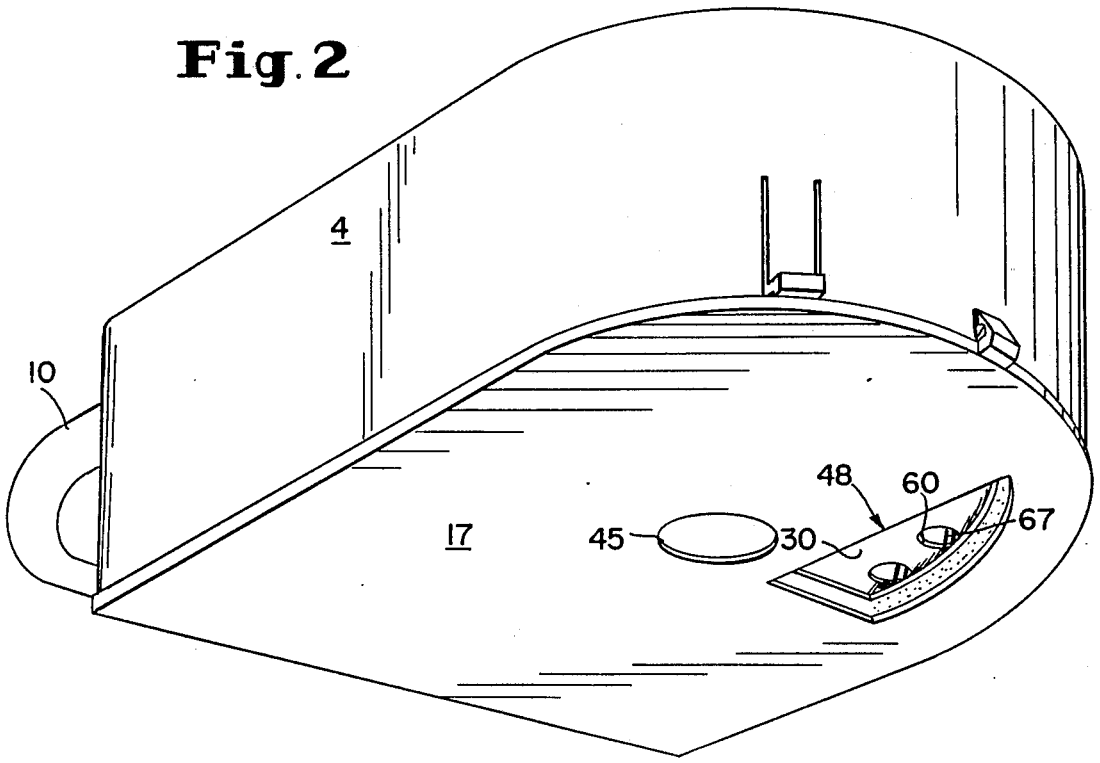
FIG. 2 is a perspective view of an assembled cassette of the first embodiment.
Figure 12:
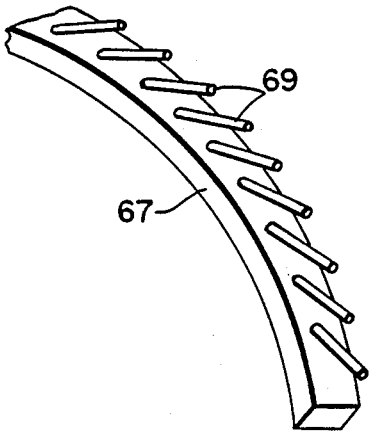
FIG. 12 is a perspective view of a barrier of the present invention.
Figure 13:
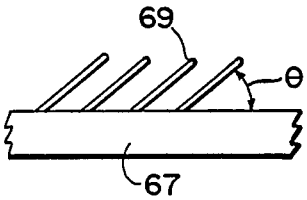
FIG. 13 is a side view of a barrier of the present invention.
Figure 14:
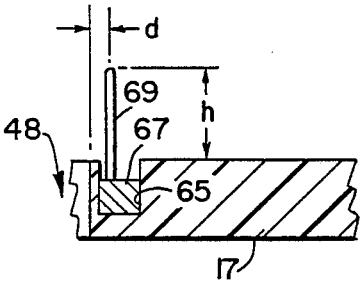
FIG. 14 is a detailed cross sectional view illustrating the mounting of a barrier to a cassette lid.

Cover 17 also includes a groove 65 (FIG. 10) into which is inserted a barrier 67 better illustrated in FIGS. 12, 13 and 14. The barrier, as illustrated in FIG. 2, acts to prevent the articles being dispensed from dropping out of the cassette when the cassette is removed from the counting unit 20. The whisker 69 of the barrier 67 project into the drug grooves 60 to prevent the drug from travelling along the groove and out of the cassette. In one embodiment, illustrated in FIGS. 13 and 14 the whiskers are positioned at an angle Θ of approximately 45° and are positioned a distance d of approximately 0.1 inches from the edge of exit hole 48 and extend a distance h of about 0.25 inches from the surface of cover 17. A wide but very shallow groove 79 is provided in the under surface of disk 30 to allow for barrier whiskers 69 without causing separation of the surface of disk 30 from cover 17.

The handle 10 of the cassette includes a recess 71 into which can be fitted a pill 73 which can serve to identify the contents of the cassette.

The counting unit 20 (FIGS. 3 and 4B) is comprised of an upper platform 24 a motor 45 with shaft 55, and a drive block 56. The counting unit 20 also includes a delivery chute 47, counting means 22, see also FIG. 5, counting, control and indicating means 18, and start switch 21.

The body 4 substantially surrounds the drum 26 while allowing free rotation of the drum. The cassette, in use, rests on platform 24 of motor drive/counter unit 20, see FIG. 4B. The surface of platform 24, as better illustrated in FIG. 11, has drop out hole 46, infrared source and detector 22 and opening 44 for drive shaft 55 and drive block 56.

The infrared source and detector 22 may be for instance a TRW Reflective Object Sensor Type OPB1-25A which employs an LED and an NPN photo Darlington circuit. The source and detector are packaged as a single unit 22, see FIGS. 4B, 5 and 11 which is inclined approximately 20° to the platform. The pills that are to be dispensed follow the path designated by the reference numeral 65 in FIG. 11 and thus are dropped into the drop-out hole 46 along the center line of the source and detector 22. An infrared transparent cover 54 illustrated in FIG. 5 such as glass, plexiglass, etc. may be disposed in front of the source and detector 22 to protect the component from damage and dust while providing a readily cleanable surface.

The cassette 14 is removably positioned on the surface 24 by sliding and tilting as illustrated by arrow E in FIG. 4B. The cassette 14 is maintained in a proper position relative to the platform 24 by resting against backwall 75 of the cabinet 77. The motor shaft 55 and drive block 56 are inserted through opening 45 in cover 17 and into drive pocket 58 in disk 30 illustrated in FIGS. 9 and 10.

Drive block 56 is square and pocket 58 is shaped as two offset square sockets to allow for ready mating and self-alignment. Spring 59 urges block 56 into engagement while allowing for initial misalignment by permitting retraction of block 56 when under depression force. As cassette 14 is lowered onto platform 24, arm 91 of trigger switch 93 is actuated, thereby activating the motor drive mechanism when cassette 14 is properly situated.

Figure 3:
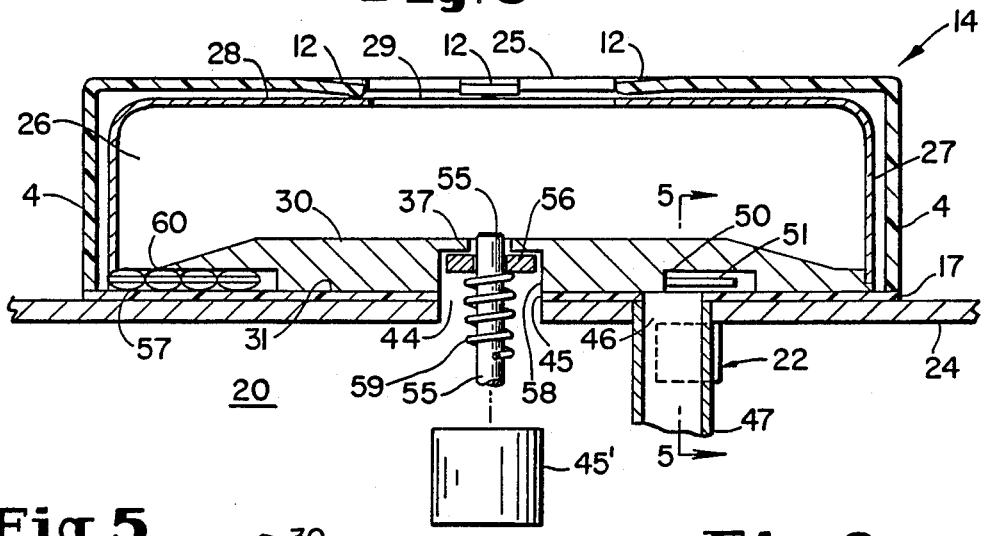
FIG. 3 is a vertical cross-sectional view of the cassette, drum and support, and the receiving slot area.
Figure 10:
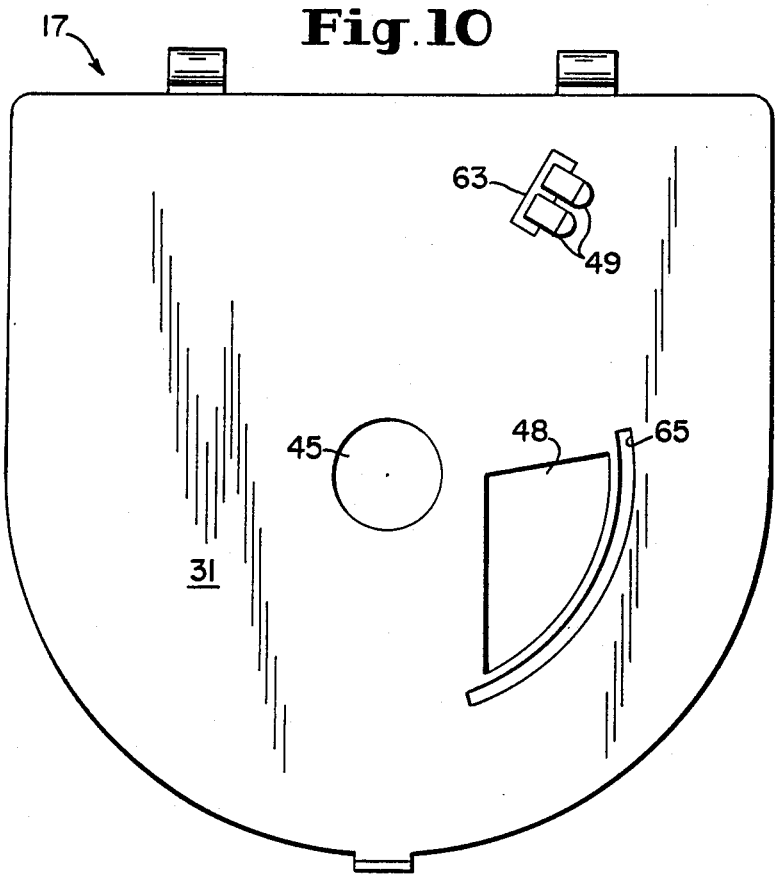
FIG. 10 is a top view of a cassette cover of the first embodiment.

The drum 26 itself illustrated in FIG. 3 is generally cylindrical and is characterized by a vertical wall 27 turned inwardly to form a top surface 28 having a central access opening 29. The bottom of the drum 26 is comprised of a circular disk 30 with slots 60. Many differing slot configurations are possible to accommodate various sizes and shapes of drugs as illustrated in FIG. 10 of and detailed in U.S. Pat. No. 4,111,332, incorporated herein by reference.

The disk 30 of the drum 26 rides on the top surface 31 of cover 17, and is held in close contact by tabs 12 formed in the top portion of body 4. Pills which fall into the slots 60 in disk 30 therefore ride in the slots and across the upper surface 31 of cover 17. Tabs 12, better detailed in FIG. 7 have a bump 16 on the lower surface to apply the necessary pressure to maintain consistent contact between the under surface of disk 30 and the surface 31 of cover 17.

Figure 9:
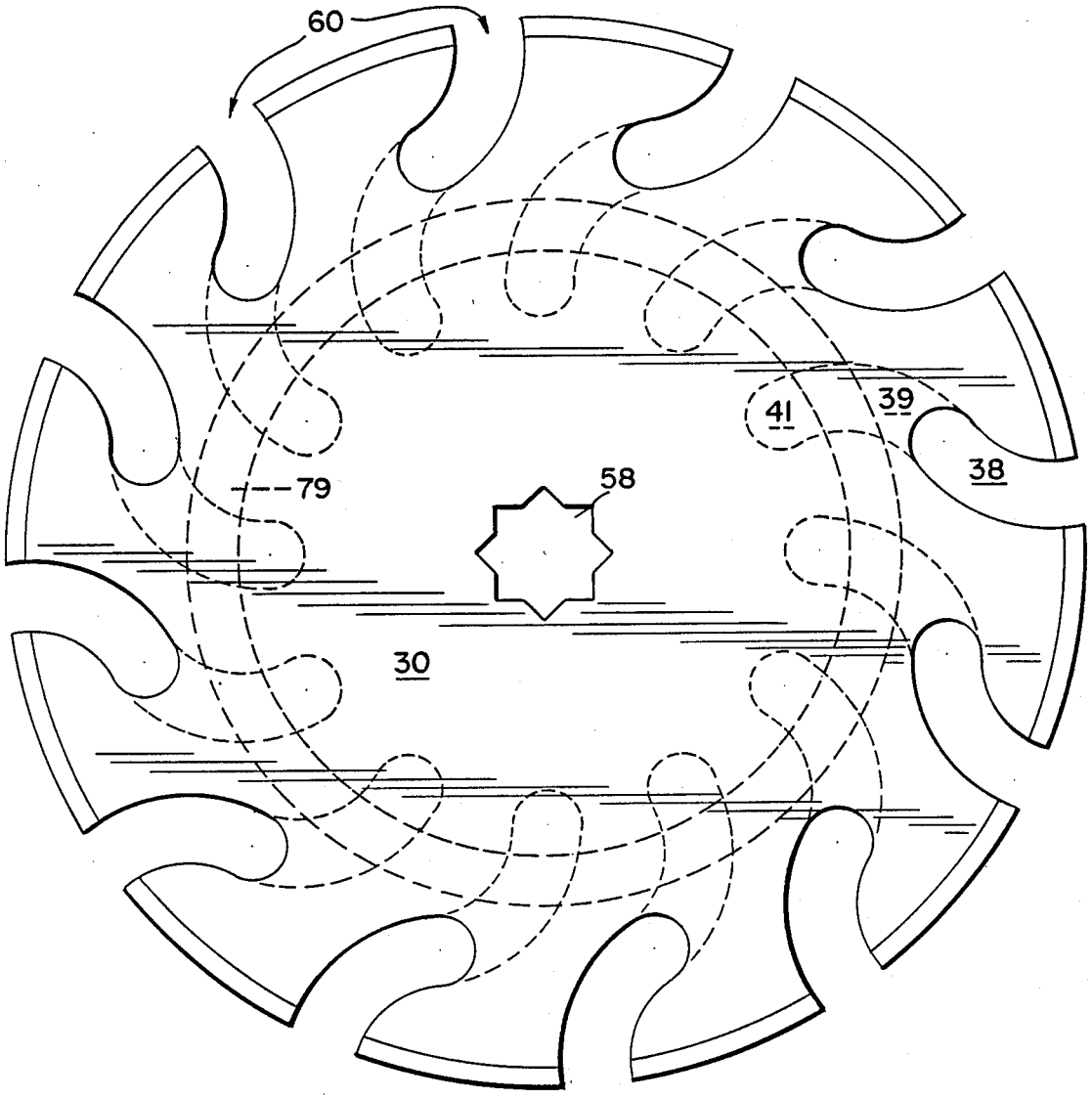
FIG. 9 is a top view of a drum disk for dispensing capsules illustrating by solid and dashed lines one configuration of the capsule receiving slots formed in the underside of the disk.
Figure 16:
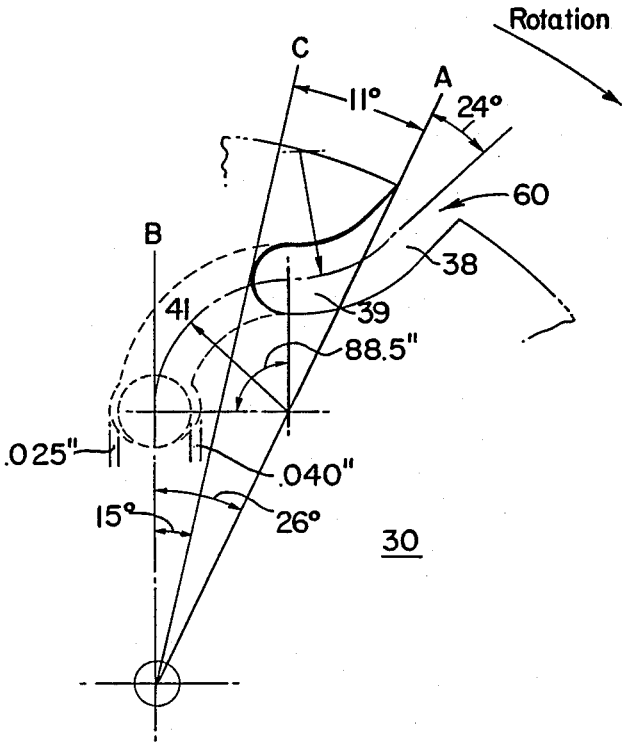
FIG. 16 is a partial top view of a drum disk illustrating the detail of a representative slot of the present invention.

Referring now to FIGS. 9 and 16, the disk 30 may acquire tablets at any location about its periphery but movement of a tablet from the outermost section of a slot into the next section is effected by gravity. Thus inward movement of a tablet normally occurs over the section of the disk in which the outer sections of the slots have a projection on the vertical.

Figure 5:
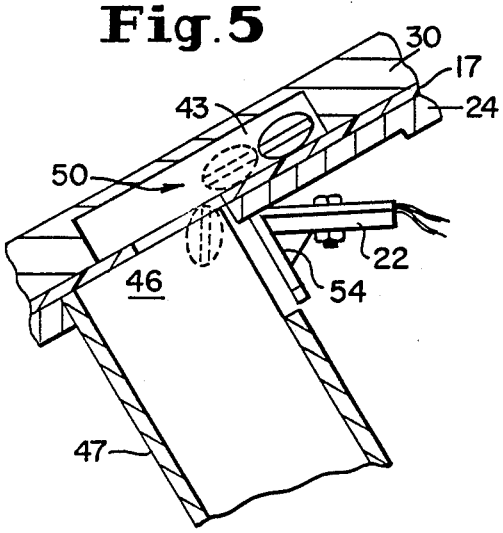
FIG. 5 is a vertical cross-sectional view taken substantially along the line 5—5 of FIG. 3.
Figure 6:
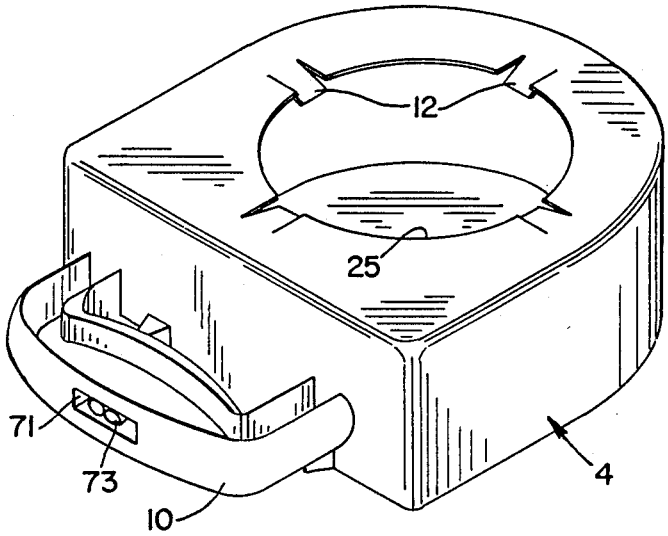
FIG. 6 is a top perspective view of a cassette body of the first embodiment.
Figure 11:
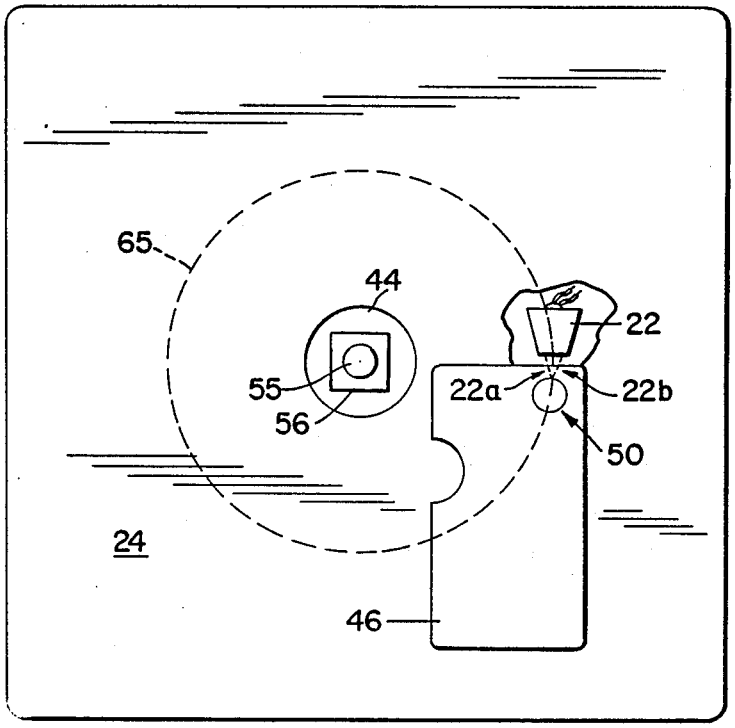
FIG. 11 is a top view of the of the support platform.

Referring to FIGS. 11, 5 and 3, a pill 50 in falling through the drop-out hole 46 intercepts an infrared beam **22*a* emanating from the source located in the device 22 and reflects the beam along path 22*b* to a sensor also located in the device 22. The inclination of the source and detector 22 insures that the pill 50** intersects the infrared beam just as it begins to fall so that its velocity is low and is readily detected.

As will be explained in detail subsequently, it is the use of this device which permits a single sensor to accommodate the large variety of tablets and capsules essential to the utilization of a single motor-counter unit 20 for the entire range of pills normally dispensed.

Continuing with the description of the mechanism of the device, it is essential to accurate operation of the mechanism that a tablet to be counted drop through the drop-out hole designated by reference numeral 46 and located at the 3 o'clock position of the surface 24 and further that only one tablet shall be dispensed. A factor relating to accurate dispensing is concerned with allowing only one tablet to be dispensed each time a slot is presented to the drop-out hole.

Referring again to FIGS. 9 and 16, directly related to the above fact is that at the time the slot section 41 approaches the drop-out hole, the slot section 39 is angled sharply downward so that any second pill falls away from the section 41 and the possibility that two pills might be dispensed is effectively obviated.

The angle of the slot section 39 is determined primarily by the need to insure seating of a tablet in section 41 before this latter section is presented to the detector 22.

The precise point of entry of a tablet into the section 38 of a slot 60 cannot be determined and may occur at any location where the section 38 has a vertical downward component. The angle of section 39 must be chosen such that a tablet entering section 38 either proceeds to its innermost location before being presented to the sensor 22 or is prevented from reaching the section 41 until after the section 41 has passed the sensor 22 and drop-out hole 48.

The slot illustrated in detail in FIG. 16 is representative of an effective and efficient slot design. As illustrated, the slot is comprised of an inner section 41, a middle section 39 and an outer or periphery section 38. The slot is essentially smoothly curved to allow unimpeded swift travel of a pill along the slot from outer to inner ends.

The center of curvature of the inner section 41 of the slot lies at a point along a first radius A approximately 1.8 to 1.9 inches outward from the center of the disk 30. This radius A is 26° clockwise, ahead, of a second radius B of disk 30 and 11° ahead of a third radius C of disk 30. The center of curvature of the middle section 39 of the slot lies along this third radius C at a distance of approximately 3.3 inches from the center of disk 30.

At the inner most end of the slot section 41, the slot is widened by 0.040 inches on the forward edge and by 0.025 inches on the trailing edge. The pill in the end of the slot will be retained by the recesses formed by the widened slot and will not slide back under the influence of gravity or pressure from a microswitch lever.

Referring now to FIGS. 3 and 5, when motor 45 is energized it drives a shaft 55 to which the disk 30 is keyed. Thus the disk 30 and drum 26 are rotated and a tablet or tablets 57 may enter the slot section 60, shown at the left hand side, as viewed in FIG. 3, and proceed through slot section 39 to slot section 41. If two or more tablets enter the slot the two innermost tablets are positioned, as shown by the right hand portion of FIG. 3, wherein the innermost tablet 50 is positioned to drop as the tablet is rotated across the opening 46 where the tablet falls by gravity into a delivery tube 47. As the slot approaches the drop-out hole the outermost tablet 51, shown in the right hand portion of FIG. 3, falls away from the innermost tablet so that two tablets cannot be dispensed.

The vast majority of all pills presently on the market can be accommodated by a single motor control and counting circuitry and a single motor incorporated into a single unit structure 20. The unit 20 is capable of accommodating a cassette 14 on its upper surface 24.

The drop-out hole 46 through the upper surface 24 of the unit 20 is sufficiently large to accommodate a tablet or capsule of any size or shape available on the market. The hole 48 (FIG. 10) in the cover 17 of the cassette 14, however, is sized to accommodate the tablet or capsule to be dispensed from the particular cassette 14. The slots in the disk 30 of the drum 26 of the cassette 14 are also specifically sized and shaped for the particular tablets or capsules to be dispensed by the cassette 14. Combining a specific disk 30 with a specific cover 17 allows for the dispensing of any desired drug.

When a cassette 14 is properly positioned on the upper surface 24 of unit 20, the drop-out hole 48 is aligned with drop-out hole 46. The shape and location of hole 48 is such that a pill dropping through hole 48 will fall through the correct area of hold 46 to trigger the detector 22.

By providing cassettes assembled to accommodate specific size and shape drugs and a base adapted to accommodate any size or shape, the present invention eliminates the need for more than a single base unit 20 so long as the sensor can also accommodate such a wide variety of sizes and shapes of pills. Any variety of drugs can be dispensed simply by having enough cassettes to accommodate the desired variety. The cassettes 14 quickly and easily are mounted and dismounted from the top surface 24 of the base 20.

The wide variety of pill shapes and sizes which will now fall through the drop-out hole 46 as opposed to a specifically designed drop-out hole of prior counters require a unique means of count detection.

A microswitch with a lever arm or a spring wire presents difficulties in detection because over a wide range of pill sizes and shapes, the lever arm will not always be contacted consistently and positive detection will not always result. Further, such arms or spring wires occasionally produce jams. Of greater importance, however, is the ability of the infrared detector to operate in the present environment essentially without error. In order to accommodate the wide variety of pills contemplated by the present invention the drop-out hole 46 must be large enough to accommodate the range of sizes of hole 48 which will vary depending on the specific drug size or shape. The infrared device is basically insensitive to shape or size of pill, ambient light, light reflections, dirt, dust and the like. If dirt or dust build-up is a problem the cover 54 of the source-detector, i.e. device 22, is merely wiped clean.

Figure 7:
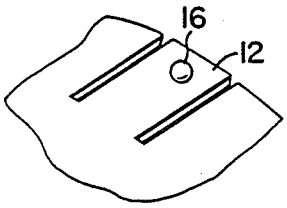
FIG. 7 is a detail view of a cassette bias tab.
Figure 15:
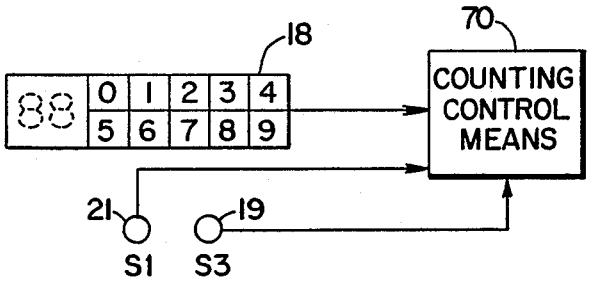
FIG. 15 is a block diagram of a control system for the device of the present invention.

Referring to FIG. 15, there is illustrated a simplified block diagram of the basic counting and control structure which is similar to that illustrated in detail as FIG. 7 of Pat. No. 3,368,713, incorporated herein by reference.

In FIG. 15, the switch 21 and switch 79 represent the reset and start sWitches. The counting control means of the unit 20 is represented by the block 70. The unit 20 also incorporates selector/indicator 18 for selecting the number of pills to be dispensed.

Referring again to FIG. 4B, the counting control and indicator means 18 and start switch 21, connected to the motor 55 and detector 22 by internal wiring, may be conventional. Commercially available solid state or electro-mechanical predetermining counting units of types which are satisfactory are manufactured by VeederRoot, Digital Systems Division of Hartford, Conn.; and ENM Company of Chicago, Ill. As indicated above, the counting control disclosed by U.S. Pat. No. 3,368,713, issued on Feb. 13, 1968, may be used, or the circuit disclosed in U.S. Pat. 4,111,332 may be used.

Since in the present invention a variety of drugs is dispensed with a single motor 55 and single detector 22, the circuitry of 3,368,713 or 4,111,332 is modified by removal of the circuits required to control a multiplicity of motors and microswitches.

Figure 17:
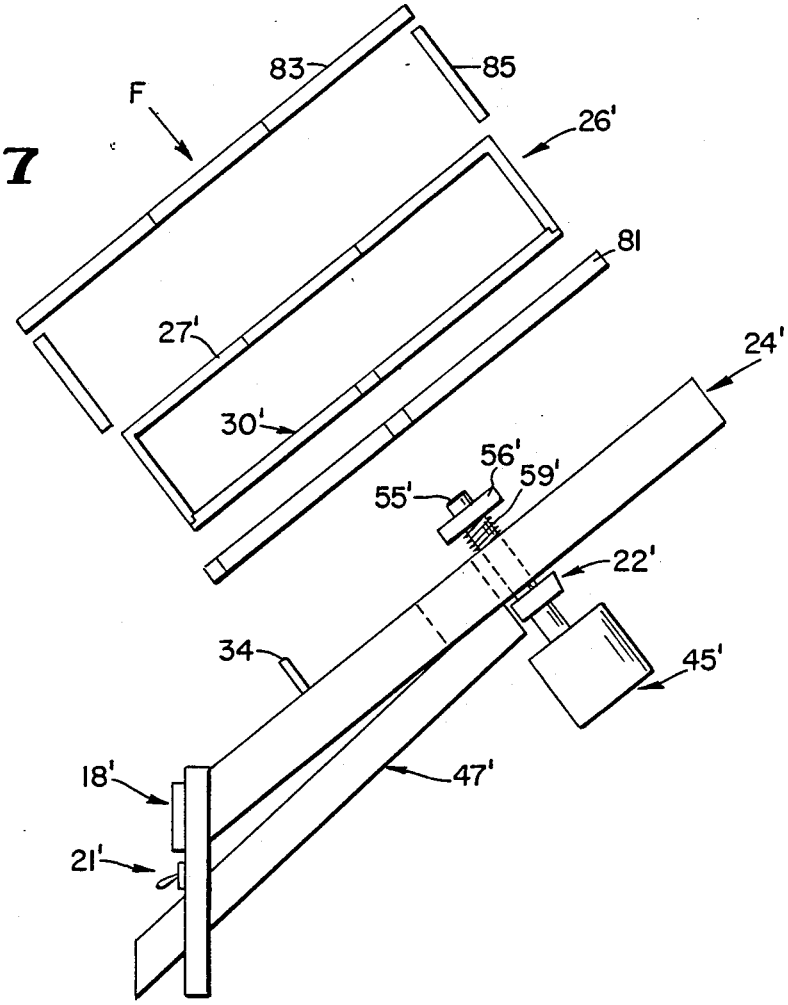
FIGS. 17 and 18 illustrate a second embodiment of the present invention.
Figure 18:
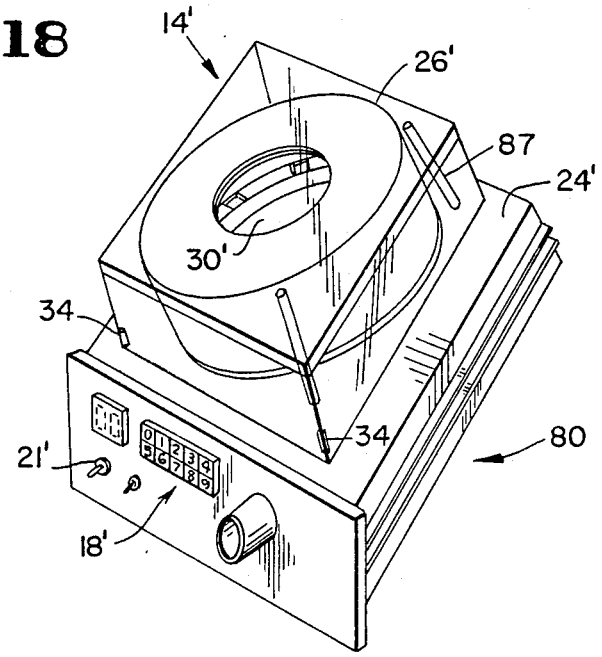

FIGS. 17 and 18 illustrate a second alternative embodiment of the present invention, wherein the cassette 14' is positioned on an incline platform 24' which angles forward instead of backward. The counting unit 80 is comprised of a platform 24' similar to 24 described above and a counter 18' and switch 21' similar to those described above. The drum 26' is identical to that detailed above, having a disk 30' and a dome portion 27'. The cassette, however, is constructed of a bottom plate 81 and a top plate 83 with side walls 85 sandwiched between. The cassette is held together by retaining posts 87 which act to maintain the drum 26' in position within the cassette.

The platform 24' is inclined forward, therefore retaining pins 34 are necessary to hold the cassette in place. The cassette is mounted by moving perpendicular to the platform 24' in the direction of arrow F.

The inclination of the platform 24 of the drug cells should be about 40 relative to the horizontal. If the angle is much greater, the articles are not collected properly by the disk for conveyance to the upper region of the (hopper) and the feed rate is materially reduced. The angle of about 40° has been found to be the angle which produces maximum feed rate. Relative to the slots in the disks, they are generally curved to allow maximum smoothness and speed of movement through the slot.

It should be noted that although the present invention is described as applicable to dispensing drugs, the principles of this invention are applicable to dispensing other types of discrete items.

Obviously the invention is susceptible to changes or alterations without defeating its practicability, therefore, we do not wish to be confined to the preferred embodiments shown in the drawings and described herein.

I claim:

1. A system utilizing an article dispensing device having a support forming an inclined upper support surface, a drive shaft projecting centrally upward through said upper support surface, means for rotating said drive shaft, said support having and article-passing opening therethrough, means for detecting an article passing through said opening and article counting means interconnecting a source of electrical energy with the means for rotating said drive shaft and said detecting means, the system comprising:

a plurality of article dispensing cassette means each adapted to overlie said upper surface, each said cassette means including an article containing rotatable drum means, a body operative to receive said article containing drum means and a non-rotating base cover with an outlet aperture, a first means removably connecting said article dispensing drum means with said drive shaft for rotation therewith, each said drum means including a dome and a disk, said dome surrounding and connected with said disk at its depending edge, said disk forming the bottom of said drum, each disk having a plurality of slot means specifically adapted to cooperate with a particular shape-size of article to select and discharge a succession of such articles in said drum through said outlet aperture into the article passing opening, and said first means connecting said article dispensing drum means to said drive shaft for quick connect with and disconnect from said shaft, wherein said article passing opening is of sufficient size and shape to accommodate all manner of articles, and said outlet aperture is sized to accommodate said particular size-shaped articles.

2. An article dispensing system according to claim 1 wherein said means for detecting an article comprises an infrared source, an infrared detector, said source directing infrared energy at an article passing through said opening in said support means, said infrared detector being positioned to detect infrared energy reflected from an article passing through said opening in said support.

3. An article dispensing system according to claim 2 wherein said source and detector are housed in a common housing and are located under said platform and directed upwardly toward the region where an article enters said opening in said platform so that an article intercepts the infrared energy at low velocity.

4. An article dispensing system according to claim 1, claim 2 or claim 3 wherein said system comprises
a plurality of said cassettes each having a disk for dispensing a specific shape and size of article.

5. An article dispenser to be employed to dispense individually discrete objects, comprising:
a base with an outlet aperture,
a circular flat disk having a top surface and a bottom surface,
said bottom surface having a plurality of slots extending inwardly from adjacent the periphery of said disk and equally spaced from one another along said bottom surface,
each said slot having a first and a second slot section, said first slot section lying closer to the center of said disk than said second slot section,
said first slot section defining a first arc of constant radius, said first slot section extending outwardly in the direction in which said disk is to be rotated in use,
said second slot section defining a second arc of constant radius extending outwardly from said first slot section to the periphery of said disk, in a direction opposite to the direction in which said disk is to be rotated and having a reverse curvature relative to said first arc, wherein:
said slot consists essentially of said first slot section and said second slot section,
said first slot being in communication with said outlet aperture, and
barrier means for selectively blocking said outlet aperture.

6. Structure as specified in claim 5 wherein said first arc sweeps 88.5°.

7. Structure as specified in claim 5 wherein the center of curvature of said first arc lies along a first radius of said disk 26° clockwise from a second radius of said disk intersecting the centerline of said first slot section adjacent its inner end.

8. Structure as specified in claim 7, wherein the center of curvature of said second arc lies along a third radius of said disk approximately 11° counter clockwise from said first radius.

9. Structure as specified in claim 5, wherein said slot further comprises a third slot section having a central axis lying at an acute angle with respect to a radius of said disk intersecting the junction of said second and third slot sections, said third slot section extending inwardly from the periphery of said disk opposite to the direction in which said disk is intended to be rotated.

10. Structure as specified in claim 9, wherein said acute angle is approximately 24°.

11. Structure as specified in claim 7, wherein said slot further comprises a third slot section having a central axis lying at an angle of approximately 24° from said first radius.

12. Structure as specified in claim 5, wherein said slot further comprises a third slot section having a central axis lying at an acute angle with respect to a radius of said disk intersecting the junction of said second and third slot sections, said third slot section extending inwardly from the periphery of said disk in the direction in which said disk is intended to be rotated.

13. Structure as specified in claim 7, wherein the centerlines of said first and second slot sections are tangential at their point of intersection.

14. Structure as specified in claim 9, wherein the centerline of said third slot section is tangential to the outer edge of said second slot section at its inner end.

15. An article counting device comprising:
a counting unit having an entrance orifice for receipt of articles and an exit chute for dispersing said articles wherein said articles are detected and counted as they enter said counting unit, and
a cassette for storage of said articles, said cassette having a body, a drum received within said body with a rotatable disk incorporating article communicating slots and a dome the bottom of the drum being defined by said disk and said dome surrounding and connected to said disk, and a cover for covering said drum connected to said body including an article passing opening configured for cooperation with said entrance orifice.

16. An article holding cassette for cooperating with an article counting unit having an entrance orifice for receipt of articles and an exit chute for dispersing said articles wherein said articles are detected and counted as they enter said article counting unit, the article holding cassette comprising;
a body having a substantially open face,
a drum configured for receipt within said body,
said drum including a slotted disk operative to select and communicate individual articles to the exit chute and a dome, said drum being rotatably mountable in said body,
a cover removably hingedly attached to said body for covering said open face and said drum, wherein said cover having an article passing opening configured for cooperation with said entrance orifice.

17. The article holding cassette of claim 16, wherein;
said drum is comprised of a disk having a substantially planar face and a dome,
said cover has a substantially planar face, and
said body having resilient means for biasing said planar face of said disk into contact with said planar face of said cover.

18. The article holding cassette of claim 16, wherein;
said counting unit further comprises a drive motor, wherein
said drum is configured for engagement with said drive motor for rotation of said drum within said body.

19. The article holding cassette of claim 16, further comprising;
barrier means adjacent said article passing opening for retaining said articles within said cassette.

20. The article holding cassette of claim 16, wherein;
a plurality of uniquely configured drums is provided, and
a plurality of uniquely configured covers is provided, wherein
said cassette can be comprised of any combination of one body, one drum and one cover.

21. The article holding cassette of claim 20, wherein;
said cassette is configured for the dispersing of a specific article by the selected combination of a specifically configured disk and a specifically configured cover.

22. The article holding cassette of claim 17, further comprising;
barrier means adjacent said article passing opening for retaining said articles within said cassette.

23. The article holding cassette of claim 22, or claim 19, wherein;
said barrier means is comprised of a plurality of filaments.

24. The article holding cassette of claim 22, wherein;
said barrier means is operatively positioned between said disk and said cover.

* * * * *